United States Patent [19]

Coryell

[11] Patent Number: 4,991,760

[45] Date of Patent: Feb. 12, 1991

[54] CLAMPING TOOL

[76] Inventor: Judith K. Coryell, 1857 23rd Ave. East, Seattle, Wash. 98112

[21] Appl. No.: 449,537

[22] Filed: Dec. 12, 1989

[51] Int. Cl.[5] ..... B26F 3/02

[52] U.S. Cl. ..... 225/106; 225/93

[58] Field of Search ..... 225/93, 100, 106, 101, 225/2

[56] References Cited

U.S. PATENT DOCUMENTS

| | | | |
|---|---|---|---|
| 126,260 | 4/1872 | Brower | 225/91 |
| 470,754 | 3/1892 | Hartig | 33/483 |
| 4,529,113 | 7/1985 | Elliott | 225/1 |
| 4,657,163 | 4/1987 | Cats | 225/106 |
| 4,782,986 | 11/1988 | Loesche | 225/1 |

*Primary Examiner*—Hien H. Phan

*Assistant Examiner*—John M. Husar

*Attorney, Agent, or Firm*—Delbert J. Barnard

[57] ABSTRACT

An elongated tool (10) includes an elongated recess (32) which extends along the full length of the tool (10). A feed strip (12) on a side of a sheet of computer paper (14) is received within the recess (32). The user moves the tool (10) to lower a grip means (38, 40) carried by the roof of the recess (32) into clamping engagement with the feed strip (12). One hand of the user is used for manipulating the tool (10) as described while the opposite hand of the user is used for applying an upward and rearwardly tearing force on the sheet (14). This causes tearing along a line of perforations (20) which is contiguous a side edge (34) of the tool (10) when the feed strip (12) is within the recess (32).

12 Claims, 2 Drawing Sheets

CLAMPING TOOL

TECHNICAL FIELD

This invention relates to a tool for facilitating the tearing of paper along a line of perforations. More particularly, it relates to the provision of a tool that is especially adapted to apply a uniform clamping pressure on a perforated feed strip on a sheet of computer paper, to facilitate tearing along a line of perforations between the sheet and the feed strip.

BACKGROUND ART

Continuous feed computer paper comes with perforated side strips which engage a feed mechanism which controls the feeding of the paper through a printer. Each sheet is connected by a line of perforations to the next sheet and each sheet has a pair of feed strips at its sides. Each feed strip is connected to the sheet of paper by a line of perforations. It is relatively easy to tear the sheets of paper apart along the line of perforations which join them. However, it is more difficult to remove the feed strips from the sheets. Often it is relatively difficult and time consuming to completely remoVe a strip from the sheet simply by pulling on the strip. Quite often, the feed strips come off in pieces.

A principal object of this invention is to provide a tool which can be quickly positioned and operated to apply a clamping force on a feed strip contiguous the perforations between it and the sheet of paper from which it is to be removed. The tool is used to clamp the feed strip against a support surface, making it relatively easy to tear along the line of perforations by pulling on the sheet of paper.

DISCLOSURE OF THE INVENTION

The tool of the invention is basically characterized by an elongated body having a base portion which includes a side edge and a lower base portion which in use is set down onto a support surface. A feed strip receiving region extends the full length of the base portion. The region is disposed laterally between the side edge and the base portion. The region has a width substantially equal to the width of a feed strip. The region also has a vertical side boundary where it meets the base portion and a roof surface which is situated above a feed strip when the feed strip is. Within the region. A feed strip grip means may be carried by the roof. The grip means is directed downwardly towards the feed strip and functions to apply a clamping pressure on the feed strip, so that the sheet can be pulled upon and torn along the line of perforations to in that manner separate it from the clamp feed strip. The tool may further include a handle extending upwardly from the base portion. The handle is usable to rotate the tool laterally for lowering the grip means into pressing contact with the feed strip.

The grip means can take many forms. Its function is to enhance the grip of the tool on the feed strip. By way of example, it can take the form of a layer of high friction material. The material may be applied as a coating or as a strip which is bonded to the recess roof. Or, the grip means can be one or a plurality of sharpened edges which project downwardly from the recess roof. For example, it can be a single continuous edge extending the full length of the recess adjacent the side edge of the tool. Or, it can be an embossed surface formed in all or a portion of the roof recess.

In preferred form, the tool body is an extrusion having a uniform cross section. The body can be formed from metal, plastic or any other suitable material.

Other objects, features and advantages of the invention are hereinafter described as a part of the description of the best mode.

BRIEF DESCRIPTION OF THE DRAWINGS

In the drawings, like element designations refer to like parts throughout and.

BEST MODE FOR CARRYING OUT THE INVENTION

Figures 1, 2, 3, 4, 5, 6:
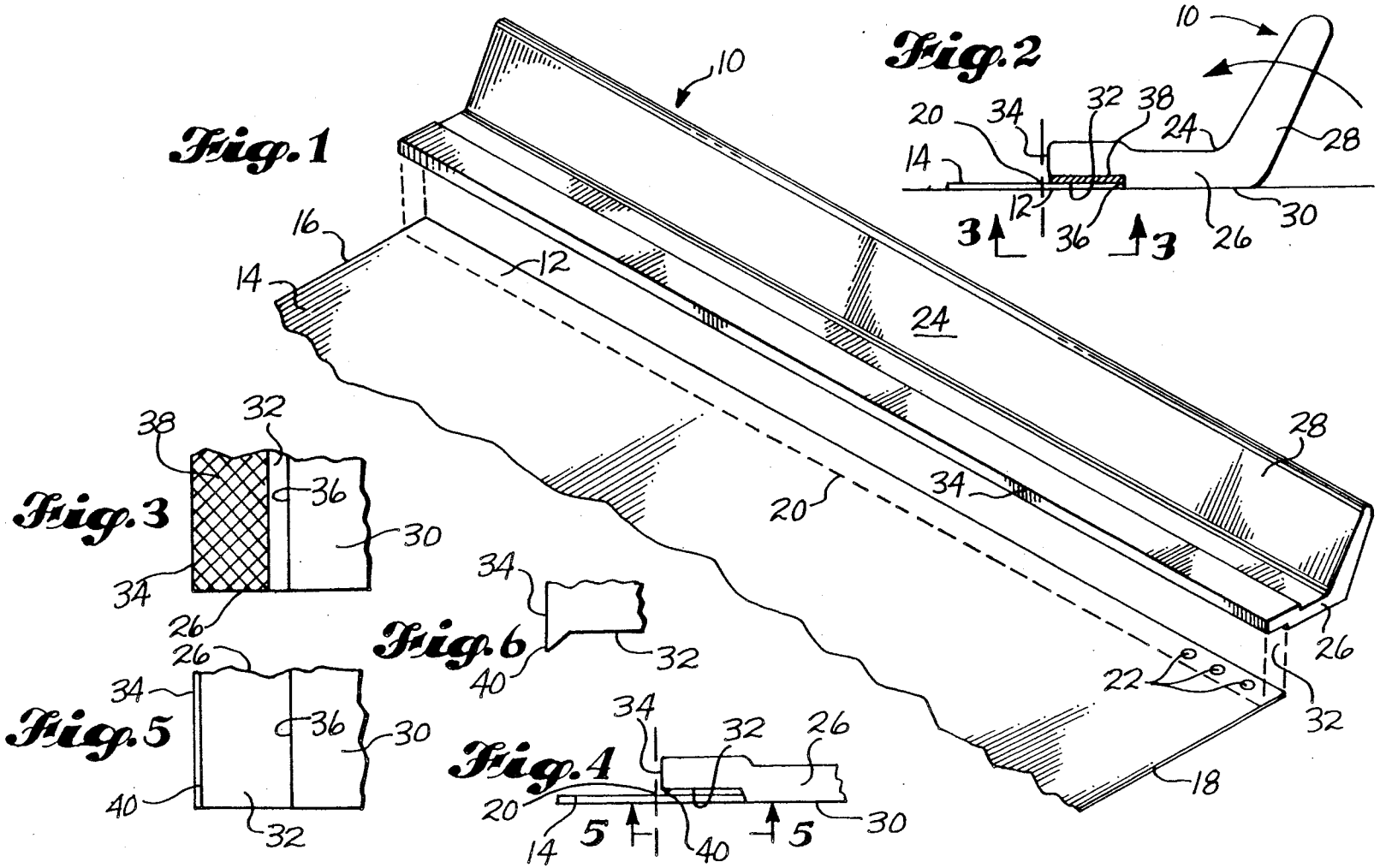
FIG. 1 is an exploded isometric view of an embodiment of the invention, shown spaced above a feed strip which extends along one side of a sheet of computer paper, with a fragmentary portion of the computer paper shown in the view.
FIG. 2 is an enlarged scale end elevational view showing a first embodiment of the tool positioned to apply a clamping pressure on a feed strip.
FIG. 3 is a fragmentary bottom plan view of a lower corner portion of the first embodiment, looking towards a strip of material having good gripping characteristics.
FIG. 4 is a fragmentary end elevational view showing a paper gripping edge in place of the grip surface.
FIG. 5 is a view like FIG. 3, but of the embodiment shown by FIG. 4.
FIG. 6 is a further enlarged scale fragmentary view of an embodiment of the gripping edge.

FIG. 1 shows a preferred embodiment of the clamping tool of the invention, designated 10. It is shown positioned above a feed strip 12 which extends along one side of a sheet of computer paper 14. The tool 10 is shown to be about seventy percent (70%) of its actual size. Computer paper sheets 14 are usually eleven inches long. The opposite ends 16, 18 of the sheet 14 are initially attached to other sheets by lines of perforations between the sheets 14. The sheets 14 are separated from each other by tearing at the lines of perforations. Each sheet 14 has a pair of feed strips 12, one at each side. The feed strips 12 are connected to the sheet 14 by lines of perforations, one of which is illustrated and designated 20 in FIG. 1. The feed strips 12 include perforations 22, only some of which are illustrated in FIG. 1. Prongs on feed wheels engage the perforations 22 and the rotation of the feed wheels advances the paper in the printer, in a known manner.

FIGS. 2–5 are enlarged scale views, With the scale being approximately one hundred and fifty percent (150%) of the actual tool 10. FIG. 6 is on a yet enlarged scale, for the purpose of better illustrating a detail which would otherwise be quite difficult to see.

Referring to FIGS. 1 and 2, the tool 10 has a body 24. Preferably, body 24 is an extrusion and can be made from a metal or a plastic material. In preferred form, body 10 comprises a base portion 26 and a handle portion 28. Base portion 26 includes a lower base surface 30. Base portion 24 also includes a feed strip receiving recess 32. Recess 32 extends along the full length of the base portion 26. Recess 32 is disposed laterally between a side edge surface 34 and the lower base surface 30. Recess 32 includes a vertical boundary 36 where the recess 32 meets the lower base surface 30. Recess 32 includes an upper roof surface which is disposed immediately above a feed strip 12 when the feed strip 12 is within the recess 32. Recess 32 has a width substantially equal to the width of the feed strip 12. When the feed strip 12 is within the recess 32, the line of perforations 20 is contiguous the side edge 34.

The roof of the recess 32 is provided with some type of grip means. What is necessary is that the roof surface be capable of firmly holding the feed strip 12 in position on a support surface. The grip means functions to apply a clamping pressure on the feed strip 12. It was found that if the feed strip 12 is firmly clamped in position, the sheet 14 can be easilY separated from the feed strip 12 by the user pulling upwardly on the sheet 14 and at the same time pulling it rearwardly.

The grip means may be in the form of a high friction surface 38 (FIGS. 2 and 3). This surface 38 may be either coated on the roof of the recess 32 or be in the form of a strip of material that is bonded to the roof of the recess 32. The material may be rubber or a rubber-like plastic material having high friction characteristics, e.g. like a rubber eraser.

The grip means may also be formed from the tool body material. For example, it may be one or more edges 40 (FIGS. 4–6) which extend along the full length of the base portion 26, adjacent the side edge 34. Or, the grip means may be an embossed pattern formed in the roof of the recess 32.

As shown by FIG. 2, in preferred form, the base portion 26 and the handle portion 28 give the tool 10 a dihedral shape. The offsetting of the handle 28 from the recess 32 provides a moment arm (the lateral dimension of the base portion 26) between the handle 28 and the side edge 32. The user can grip the handle 28 and rotate it slightly in the direction indicated by arrow 42. This will result in a considerable pressure being applied by the grip means on a feed strip 12 within the recess 32.

As will be apparent, the tool 10 can be easily handled and can be easily and quickly moved by a user into a position to place a feed strip 12 within the recess 32. Then, by a slight wrist action, the handle 28 can be rotated, in the manner indicated, to firmly clamp the feed strip 12 down against the support surface. The user's other hand can then be used for applying the upward and rearwardly directed tearing force on the sheet 14.

The tool body 24 is constructed to have substantial thickness. This allows the formation of a lower base surface 30 which remains substantially planar. It also allows the formation of a recess 32 which has and retains a true shape. Also, the body 24 is relatively rigid so that the rotating force applied on the handle 28 will be transmitted as a clamping force on the feed strip 12, rather than being absorbed by bending of the tool body.

Figure 7:
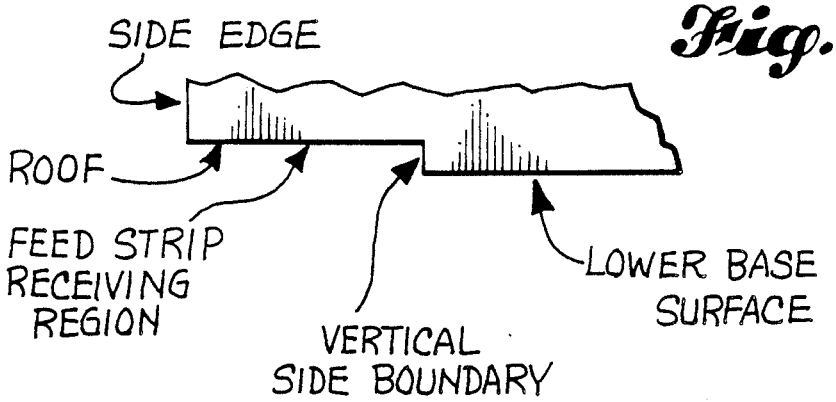
FIG. 7 is a diagram, in cross sectional format, showing the basic operational portions of the tool.

FIG. 7 is a diagram of the basic parts of the tool. As illustrated, the tool must include a lower base region of surfaces. There must be a feed strip receiving region located laterally between a side edge of the tool and a vertical side boundary which is contacted by the outer edge of the feed strip. The feed strip receiving region is substantially equal in width to the feed strip. The provision of the vertical side boundary makes it easy and almost automatic to position the feed strip within the feed strip region and end up with the line of perforation substantially at the side edge.

The embodiments of FIGS. 1–6 are rotated in position to apply a clamping pressure on the feed strip. such embodiments are illustrated to include a handle. However, even, if the handle were to be omitted, a vertical downward pressure on the body, above the feed strip receiving region, would cause a rotation of the body to move the roof downwardly to the feed strip.

FIGS. 8–12 show additional embodiments, each of which is characterized by a construction permitting a vertical downward movement of the portion of the body located above the feed strip receiving region relative to the portion of the tool which rests on the support surface.

Figure 8:
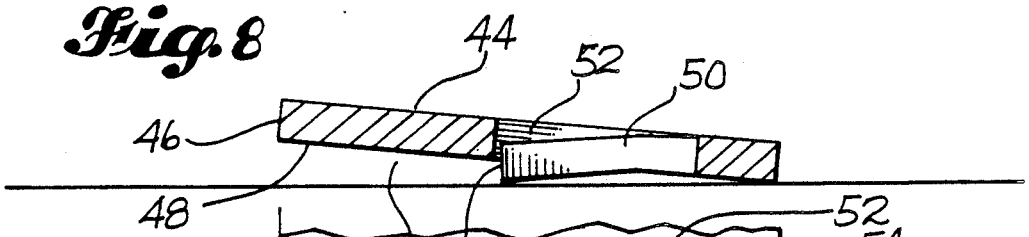
FIG. 8 is a sectional view of a another embodiment, taken substantially along line 8—8 of FIG. 9.
Figure 9:
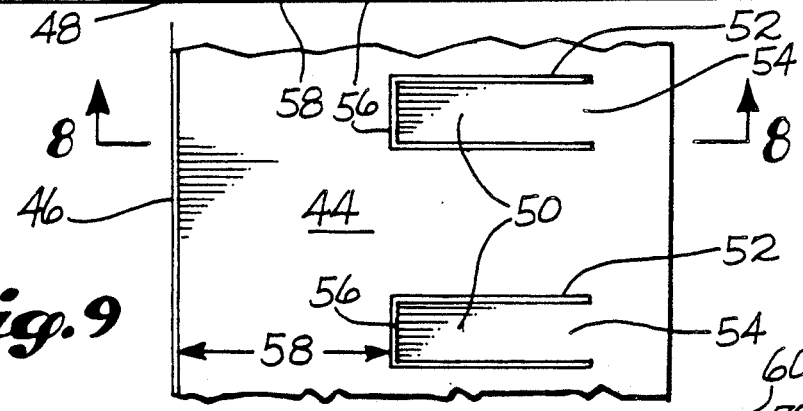
FIG. 9 is a fragmentary bottom plan view of the embodiment; of FIG. 8.

Referring to FIGS. 8 and 9, tool 44 is shown to comprise an elongated body which includes aside edge 46, and a roof surface 48. Body 44 is formed to include a plurality of abutments 50 which are in the nature of cantilever beams. A three-sided cut is made at 52 to form each beam 50. Each beam 50 includes a fixed end 54 and a free end 56. Each beam 50 is bent so that its at rest. Shape is as shown in FIG. 8. This places the free end 56 in a downwardly offset position relative to the plane of the body 54. The lower surfaces of the beams 50 constitute at least a portion of the lower base surface of the tool. As shown by FIGS. 8 and 9, a freed strip receiving region 58 is defined laterally between side edge 46 and abutment free ends 56. The abutments or beams 50 are in the nature of cantilever beams. They can also be termed leaf springs. In use, the tool 44 and a feed strip portion of paper are moved relatively together to place the feed strip within the region 58, with its outer edge against end surfaces 56 of the abutments 50. Then, a downward pressure is applied on the tool 44. This causes the portion of tool 44 that is above region 58 to move vertically downwardly into clamping engagement with the feed strip. The roof 48 may include a grip means, such as the grip means described above in connection with FIGS. 1–6.

Figure 10:
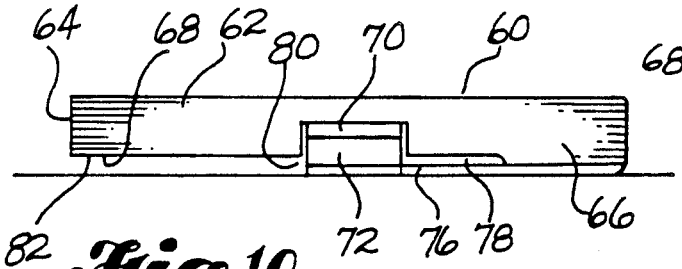
FIG. 10 is an end elevational view of a further embodiment, taken substantially along the aspect of line 10—10 of FIG. 11.
Figure 11:
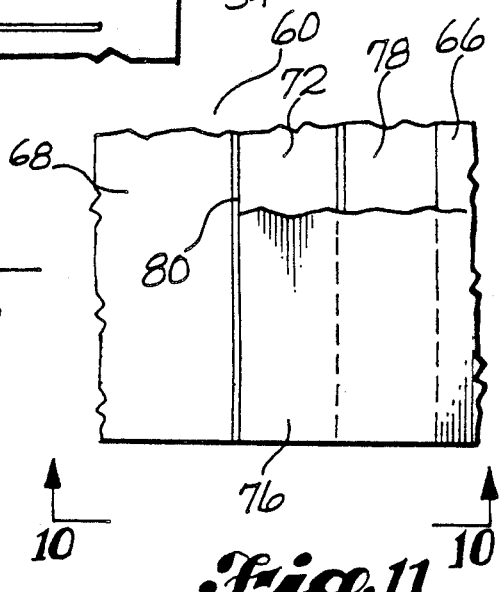
FIG. 11 is a fragmentary bottom plan view of the embodiment of FIG. 10, with foreground portions broken away.

The tool 60 shown by FIGS. 10 and 11 comprises an elongated member or body 62 having a side edge 64, a base portion 66 and a roof 68. A channel 70 extends lengthwise of body 62. As in the case of the earlier embodiments, the body 62 is substantially as long as a sheet of computer pater. Tool 60 includes an elongated member 72 which is received within the channel 70. A thin planer member 76 underlies member 72 and the base portion 66 of body 62 and is secured to both. Plate member 76 functions as a leaf spring. A clearance space 78 exists vertically between member 76 and bodY 62, in the region laterally between member 72 and base portion 66. The vertical side boundary of the tool is formed by a side edge 80 of member 72. A feed strip receiving region 82 is defined laterally between side edge 64 and vertical side boundary 80. The tool 60 functions in the same manner as the tool 44. That is, the tool 60 and the feed strip are moved relatively together so to position the feed strip within the recess 82, with its outer edge against the surface 80. Then, a downward pressure is applied on body 62, so as to depress body 62 and move roof surface 68 down into a clamping position on the feed strip. Then, the computer paper is lifted and tore free from the feed strip.

Figure 12:
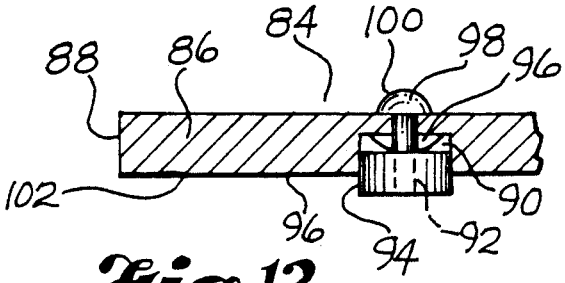
FIG. 12 is a fragmentary cross sectional view of yet another embodiment, with parts in elevation.

Tool 84 shown by FIG. 12 comprises a body 86 having a side edge 88. A plurality of sockets 90 are spaced apart lengthwise of the body of the body 86. Each socket receives an abutment 92. Abutments 92 have surface portions 94 which are aligned with each other lengthwise of the body 86. A feed strip receiving region 96 is defined between the side edge 88 and the edge portions 94 of the abutments 92. A spring 96 is positioned within each socket 90, between the roof of the socket 90 and the abutment 92 which is located within such socket. A connector pin 98 extends through an opening within body 86 and at its lower end is connected to the abutment member 92. Each connector pin 98 includes an enlarged head 100 at its upper end which functions as a stop to limit downward movement of pin 98 and member 92. The springs 96 may be leaf springs, coil springs, spring washers, or any other suitable spring or device capable of functioning as a spring, e.g. a body of resilient material.

The embodiment of FIG. 12 is used in the same manner as the embodiments of FIGS. 8–11. That is, the tool 84 and the feed strip of the computer paper are moved relatively together so as to place the feed strip within region 96, with its outer edge against the surface portions 94. Then, a downward pressure is applied on body 86, so as to move body 86 downwardly and roof 102 into clamping contact with the feed strip. As in the earlier embodiments, the roof 102 may be provided with some sort of grip means for facilitating the clamping of the feed strip during the tearing of the computer paper free from the feed strip.

In preferred form, each embodiment of the tool is a hand held tool. However, it is within the purview of the invention to make a tool of the type described which is a part of the printer through which the computer paper is fed.

The embodiments which have been described above are presented for illustration and not limitation. I am only to be limited to the wording of the claims which follow, interpreted in accordance with the rules of patent claim interpretation, including the use of the doctrine of equivalents.

What is claimed is:

1. A tool usable in connection with a support surface that is separate from the tool, for facilitating removal of feed strips from a sheet of computer paper to which the feed strips are connected by lines of perforations which extend lengthwise of the sheet, comprising:

an elongated body having a side edge and a base portion, said base portion having lower surface means which can be set onto the support surface;

a downwardly directed feed strip receiving region extending the full length of the body, said region being disposed laterally between the side edge and the lower surface means, said region having a width substantially equal to the width of the feed strip, said region having a downwardly directed roof surface which is situated above and confronts a feed strip within the region and a vertical side boundary bordering the lower surface means, said vertical side boundary extending downwardly from the roof surface to the lower surface means;

said downwardly directed roof surface being normally spaced above the lower surface means a distance allowing the tool and a sheet of computer paper to be moved relatively together to insert a feed strip into the region; and said tool being movable while on the support surface to lower the roof surface onto the feed strip, so that the roof surface can apply a clamping pressure on the feed strip, clamping the feed strip between the roof surface and the supporting surface, allowing the sheet to be pulled upon and torn along the line of perforations to in that manner separate it from the clamped feed strip.

2. A tool according to claim 1, further comprising a layer of enhanced friction material on the roof surface.

3. A tool according to claim 1, wherein the roof surface has at least one edge which projects downwardly from the roof surface for engaging the feed strip.

4. A tool according to claim 1, wherein said elongated body is an extrusion having a uniform cross section and said feed strip receiving region is a recess in said body.

5. A tool according to claim 4, further comprising a layer of enhanced friction material on the roof surface of the recess along the full length of the recess.

6. A tool according to claim 4, further comprising at least one edge which extends along the length of the recess and projects downwardly from the roof surface of the recess.

7. A tool according to claim 1, further comprising a handle extending upwardly from the base portion and usable to rotate the tool laterally, for lowering the grip means into pressing contact with the feed strip.

8. A tool according to claim 1, comprising abutment means disposed lengthwise of the elongated body, said abutment means including the vertical side boundary of the feed strip receiving region, wherein said abutment means includes said lower surface which rests on the support surface means when the base of the elongated body is on the support surface, and wherein the elongated body is vertically moveable relative to said abutment means, so that a downward force can be applied onto the elongated body and the roof surface will be moved downwardly into clamping contact with a feed strip within the feed strip receiving region.

9. A tool according to claim 8, wherein said abutment means comprises a plurality of cantilever beam sections spaced a part along the elongated body, each cantilever beam section having a fixed end which is a part of the elongated body and an opposite free end which includes the vertical side boundary.

10. A tool according to claim 8, wherein the elongated body includes a longitudinal channel and the abutment means comprises an elongated member situated in said channel, and said tool includes spring means between said elongated member and said elongated body, said spring means permitting vertical movement of said elongated body relative to said elongated body.

11. A tool according to claim 8, wherein said abutment means comprise a plurality of members spaced a part longitudinally of the elongated body, and spring means between each said member and the longitudinal body, said spring means allowing vertical downward movement of the elongated body relative to said members.

12. A tool according to claim 1, wherein said elongated body has a handle which projects upwardly and outwardly at a dihedral from the base portions on the side of the body opposite the downwardly directed feed strip receiving region, in a position to be usable for isolating the tool laterally, for lowering the grip means into pressing contact with the feed strip.

* * * * *